United States Patent [19]

Radwill

[11] 4,103,623

[45] Aug. 1, 1978

[54] SQUARING FRICTIONALLY SNUBBED RAILWAY CAR TRUCK

[75] Inventor: Robert P. Radwill, Oak Lawn, Ill.

[73] Assignee: AMSTED Industries Incorporated, Chicago, Ill.

[21] Appl. No.: 753,790

[22] Filed: Dec. 23, 1976

[51] Int. Cl.[2] ..... B61F 5/06; B61F 5/12; B61F 5/24; B61F 5/50

[52] U.S. Cl. ..... 105/197 DB; 267/9 A

[58] Field of Search ..... 105/197 D, 197 DB; 267/3, 4, 9 A, 9 C

[56] References Cited

U.S. PATENT DOCUMENTS

| | | | |
|---|---|---|---|
| 2,053,989 | 9/1936 | Goodwin | 105/197 DB |
| 2,053,990 | 9/1936 | Goodwin | 105/197 DB |
| 2,237,953 | 4/1941 | Webb | 105/197 DB |
| 2,347,463 | 4/1944 | Couch | 105/197 DB |
| 2,465,763 | 3/1949 | Taylor | 105/197 DB |
| 2,712,796 | 7/1955 | Shafer | 105/197 D |
| 2,729,173 | 1/1956 | Couch | 105/197 D X |
| 2,731,923 | 1/1956 | Couch | 105/197 D |
| 2,751,856 | 6/1956 | Maatman | 105/197 DB |
| 2,883,944 | 4/1959 | Couch | 105/197 D |
| 2,953,995 | 9/1960 | Baker | 105/197 DB |

*Primary Examiner*—Drayton E. Hoffman
*Assistant Examiner*—Howard Beltran
*Attorney, Agent, or Firm*—Fred P. Kostka

[57] ABSTRACT

A friction shoe is provided on a railway car truck to frictionally engage both the side frame column and bolster in order to control the oscillating movement of the latter. The interfaces between the friction shoe and its reaction surfaces on the side frame and bolster are arranged so that initial contact is made against surfaces adjacent the lateral ends of the shoe, thereby providing the maximum restraining moment to resist lozenging of the truck.

9 Claims, 10 Drawing Figures

FIG. 1
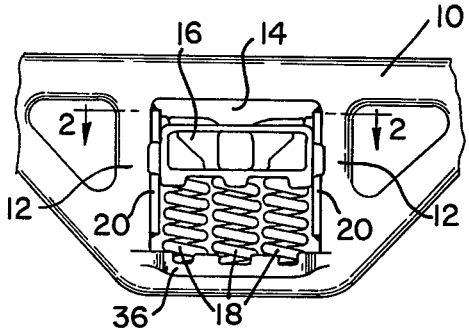
FIG. 2
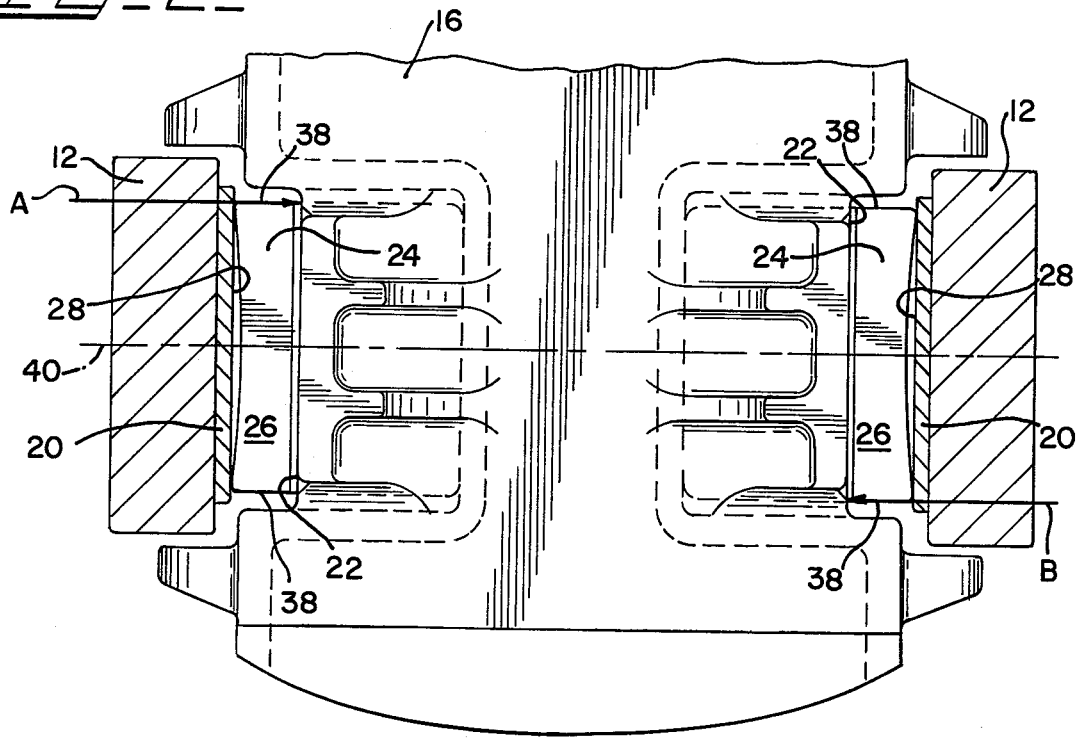
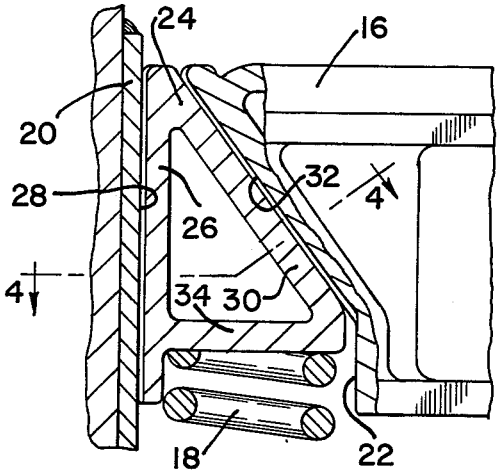
FIG. 3

SQUARING FRICTIONALLY SNUBBED RAILWAY CAR TRUCK

BACKGROUND AND SUMMARY OF THE INVENTION

The present invention relates to a device for resisting the tendency of a railway car truck to lozenge or get out of square. More particularly the invention relates to a novel configuration of the interfaces between the friction shoe and its reaction surfaces on the side frame and bolster.

The type of railway car truck to which the present invention relates comprises, generally, spaced side frame members each having an opening arranged to resiliently support opposite ends of a bolster. The side frame members are substantially parallel to one another, and the bolster is normally perpendicular to the plane of both side frames.

Occasionally, however, one side frame member, while remaining parallel to the other member, may get slightly ahead of the other member. In this condition, which is known as lozenging, the bolster is no longer perpendicular to the side frame members. Lozenging is a result of the railway car truck hunting back and forth across the tracks rather than rolling straight with respect to the tracks. This hunting or lateral instability generally occurs with a truck of the type herein described at speeds above about 60 km/hr under light load conditions. Lozenging decreases the truck hunting threshold speed and lateral stability as compared to squared trucks.

The lateral instability may result in increased wheel flange and track wear, and lozenging is therefore an important operating concern of the railroad industry. It has been observed that the speed threshold at which lozenging occurs can be increased with a squared truck.

It is a primary object of the present invention to provide a railway car truck constructed and arranged to overcome the difficulties encountered heretofore and thereby improve the safe and efficient operation thereof.

According to the present invention this is accomplished through the friction shoe arrangement. Friction shoes are provided to frictionally engage both the side frame column and bolster. The degree of squaring or resistance to lozenging is dependent on the restraining moment developed by the friction shoes. Therefore, an increase in restraining moment results in an increased truck hunting threshold speed.

Heretofore, although truck designers have illustrated friction shoes as having contact surfaces with some appropriate manufacturing tolerance, there has been no predetermined attempt to control initial contact areas to develop the maximum restraining moment.

This invention discloses several ways in which the restraining moment may be maximized and better retained as wear of the friction shoe develops.

BRIEF DESCRIPTION OF THE DRAWINGS

FIG. 1 is a fragmentary side elevational view of a railway car truck embodying the present invention;

FIG. 2 is a view, partly in section, taken along line 2—2 of FIG. 1;

FIG. 3 is a fragmentary side elevational view of the side frame column, friction shoe and bolster with part of the bolster broken away to show underlying details of structure;

DESCRIPTION OF THE PREFERRED EMBODIMENTS

Figure 4:
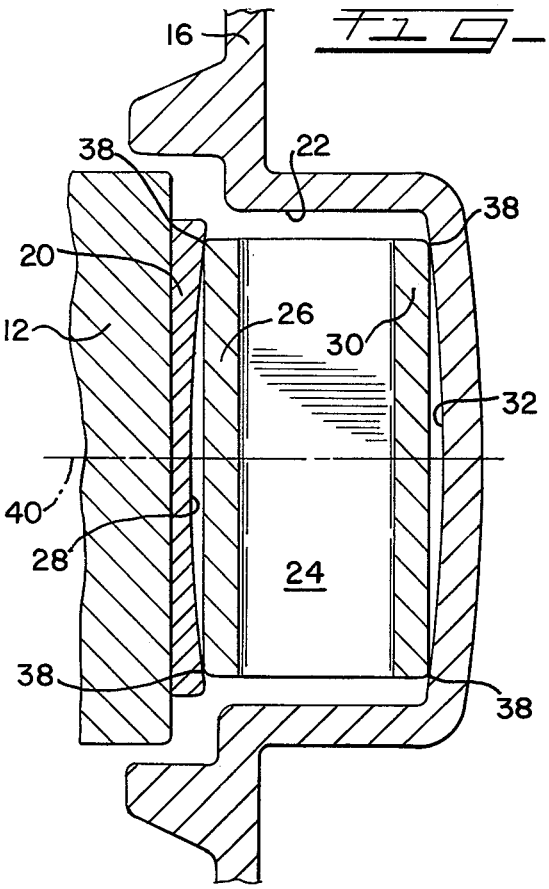
FIG. 4 is a fragmentary sectional view taken generally along line 4—4 of FIG. 3 and illustrating the side frame column, friction shoe and bolster of one embodiment of the present invention.

Referring now the the drawings, in FIG. 1 there is shown a side frame 10 having a pair of columns 12 defining the sides of a bolster opening 14 formed in the frame. One end of a bolster 16 is resiliently supported in the bolster opening 14 on springs 18. Friction plates 20 may be integral with or suitably mounted on the side frame columns 12.

As shown in FIG. 2, friction shoe pockets 22 are formed on opposite sides of bolster 16 adjacent each side frame column 12. The pockets each receive a friction shoe 24 having a friction wall 26 which frictionally engages a friction surface 28 on friction plates 20.

FIG. 3 shows that friction shoe 24 has an inclined wall 30 opposite friction wall 26. Inclined wall 30 frictionally engages a guiding surface 32 in friction shoe pocket 22 of bolster 16. Friction shoe 24 is urged into frictional engagement with surfaces 28 and 32 by at least one of the springs 18 which is compressed between lower wall 34 of friction shoe 24 and spring seat 36 of side frame 10 (FIG. 1).

Heretofore, no predetermined attempt has been made to control the initial contact points at the friction shoe-side frame and friction shoe-bolster interfaces. The actual manner in which friction shoe walls 26 and 30 contact the respective friction surface 28 and guiding surface 32 has been left to chance.

It has been discovered that a railway car truck's resistance to lozenging is improved by increasing the restraining moment developed by the friction shoe. This invention discloses several embodiments in which this restraining moment may be maximized and better retained as wear of the friction shoe develops. Generally, this is accomplished by causing friction wall 26 and inclined wall 30 of friction shoe 24 to initially contact friction surface 28 and guiding surface 32 near the lateral ends 38 of walls 26 and 30. The lateral ends 38 are those ends of walls 26 and 30 which are spaced farthest from the longitudinal axis 40 of the side frame 10 (FIG. 2).

In one embodiment of the invention as shown in FIG. 4, the friction shoe 24 is formed so that friction wall 26 and inclined wall 30 have generally flat contact surfaces. However, friction surface 28 of friction plate 20 and guiding surface 32 in pocket 22 are laterally concave in opposing relationship. Therefore, when friction shoe 24 is urged into engagement with surfaces 28 and 32, initial contact occurs along the lateral ends 38 near the opposite terminal ends of the concave surfaces. With this arrangement, as wear develops on surfaces 28 and 32 and friction shoe walls 26 and 30, contact between these surfaces and walls along the lateral ends 38 will be maintained. This causes the friction shoe to contact the bolster and side frame along the lateral ends of the shoe and develops the maximum moment for restraining lozenging of the truck.

Due to actual manufacturing conditions, the interfaces between the friction shoe and its reaction surfaces on the side frame and bolster may occasionally be produced so that a new friction shoe may contact the side frame and bolster along only three of the four lateral ends 38. If this condition should occur, the friction shoe will soon wear in so that contact will be established along all four lateral ends 38 thereby providing the maximum moment for restraining lozenging of the truck.

When the truck attempts to lozenge, the bolster tends to rotate slightly in a horizontal plane. As viewed in FIG. 2, the bolster 16 may tend to rotate, for example, in a counter-clockwise direction. As a result of this slight rotation, the friction shoe at the left of FIG. 2 exerts a force on bolster 16 along the lateral end 38 near the top of FIG. 2. At the same time, the friction shoe at the right of FIG. 2 exerts a force on bolster 16 along the lateral ends 38 near the bottom of FIG. 2. These two forces are indicated in FIG. 2 by the arrows A and B, respectively.

Therefore, whenever the bolster 16 begins to move out of its perpendicular relationship to side frame 10, a restraining moment of the forces A and B will be exerted on bolster 16 urging it back into a perpendicular relationship with side frame 10. This enhanced truck squaring, or resistance to lozenging, results in an increased truck hunting threshold speed. Increasing the speed at which the truck begins to hunt represents a significant advantage in freight car operations.

Figure 5:
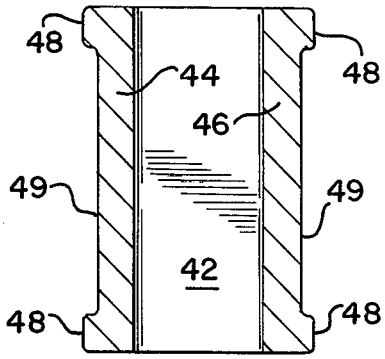
FIGS. 5, 6 and 7 are sectional views of the friction shoe only as though taken along line 4—4 of FIG. 3 and illustrating three alternative embodiments of friction shoes.
Figure 6:
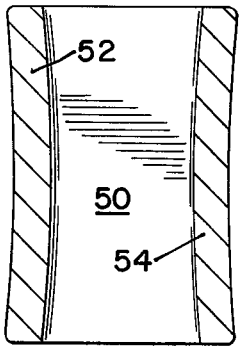
Figure 7:
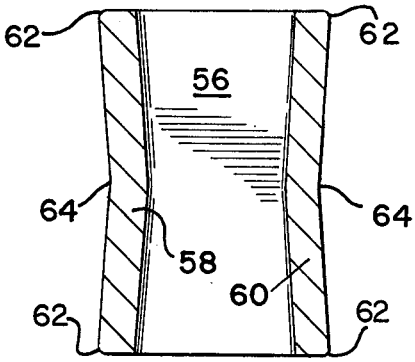

FIGS. 5, 6 and 7 illustrate alternative embodiments of the invention. Any of these three configurations of the friction shoe may be used on a truck having friction surfaces 28 and guiding surfaces 32 which are generally flat.

FIG. 5 illustrates a friction shoe 42 with a friction wall 44 and an inclined wall 46, each will having raised flat surfaces 48 along both lateral ends with the center portion 49 being recessed.

FIG. 6 shows a friction shoe 50 having a friction wall 52 and an inclined wall 54 wherein the contact surface of each of said walls is laterally concave.

FIG. 7 illustrates a friction shoe 56 having a friction wall 58 and an inclined wall 60. Each of said walls is formed of two surfaces tapered inwardly with respect to friction shoe 56 from the lateral ends 62 toward the center 64 of each wall. These tapered surfaces form a concave dihedral angle in each wall with its apex near the center of the wall.

It should be noted that any combination of the above configurations is within the purview of this invention. That is, any of the alternative embodiments shown in FIGS. 5, 6 and 7 can be used with a friction surface 28 or guiding surface 32 that is laterally concave.

In each of the above embodiments of this invention it is important that the friction shoe walls contact the friction and guiding surfaces adjacent the lateral ends of said walls. However, wear will occur at an undesirably high rate if the distance along axis 40 between the friction shoe wall and the surface which it engages is too great. Therefore, the exact configuration of these walls and surfaces must be carefully controlled. The best results can be achieved, in terms of maximizing the degree of truck squaring and retaining that squaring effect with a friction shoe having a long wear life, if the maximum distance between the friction shoe walls and the surfaces which they engage is about 1.5 mm.

Figure 9:
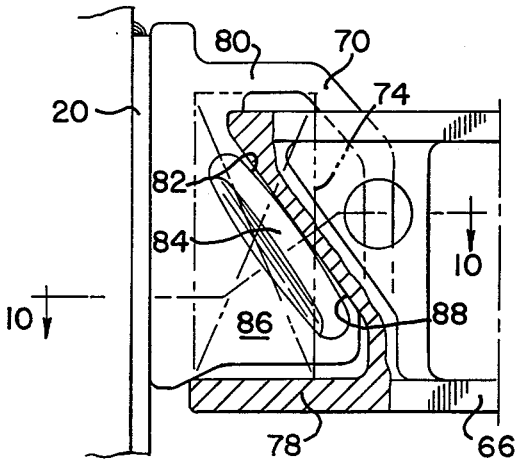
FIG. 9 is a detailed side elevational view of the side frame column, friction shoe and bolster of FIG. 8 with part of the bolster broken away.
Figure 8:
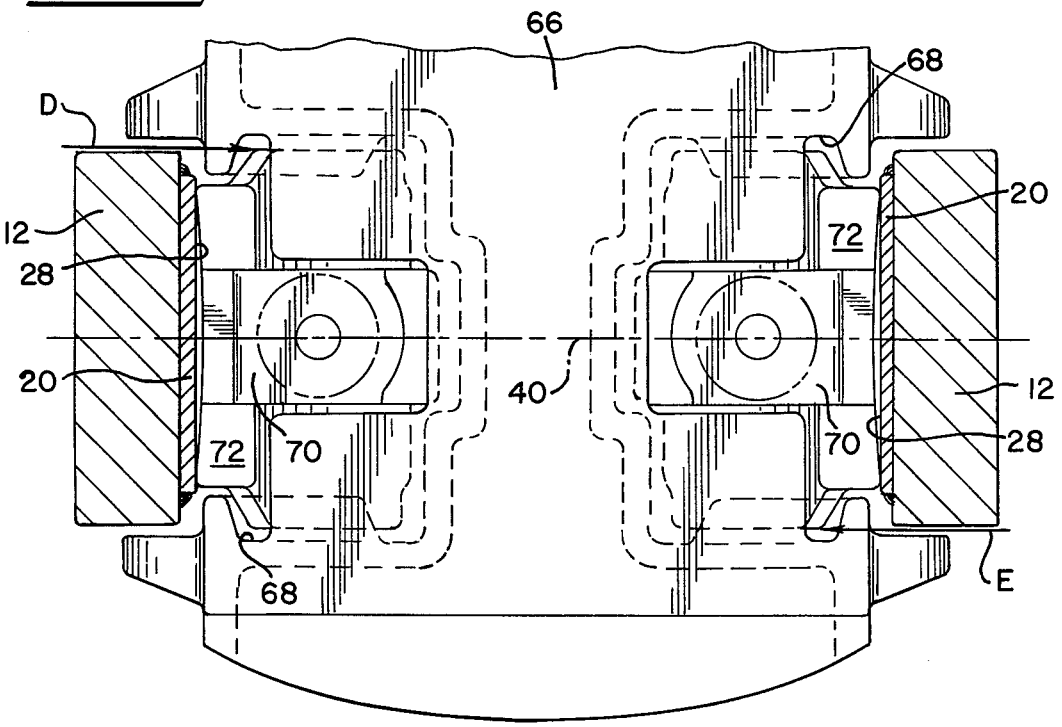
FIG. 8 is a view, partly in section, taken as though along line 2—2 of FIG. 1, but illustrating still another embodiment of the invention.
Figure 10:
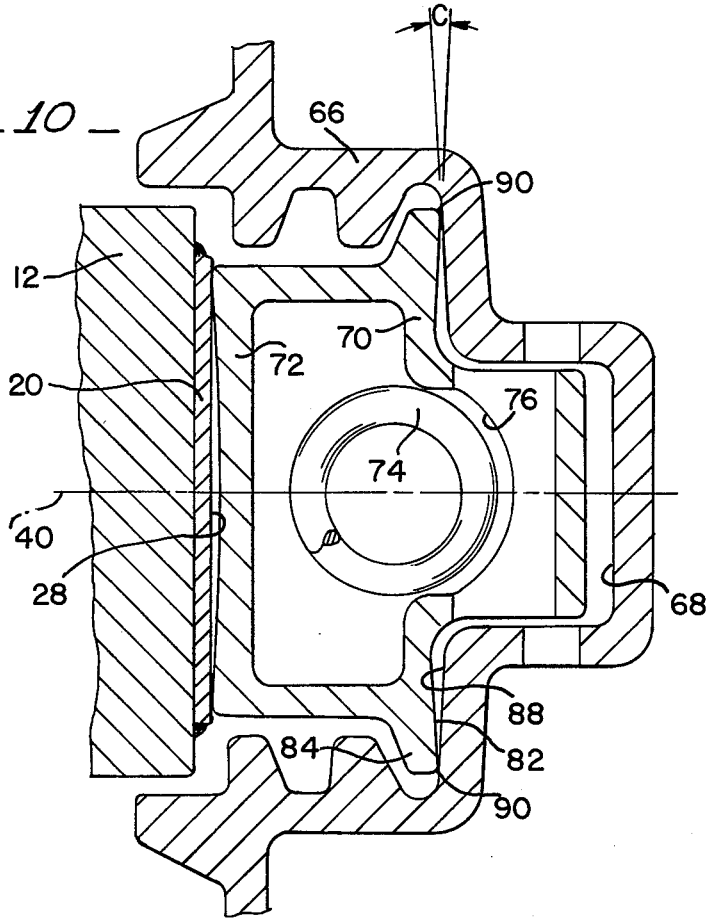
FIG. 10 is a fragmentary sectional view taken generally along line 10—10 of FIG. 9.

FIGS. 8, 9 and 10 show the application of this invention to a railway car truck employing winged-type friction shoes wherein there are a pair of inclined wings on the friction shoe rather than a single inclined wall as shown in the embodiments of FIGS. 1 through 7. FIG. 8, like FIG. 2, shows a bolster 66 formed with friction shoe pockets 68 on opposite side of bolster 66 adjacent each side frame column member 12. The pockets each receive a friction shoe 70 having a friction wall 72 which frictionally engages friction surface 28 of side frame column friction plate 20.

Friction shoe 70 is urged into frictional engagement with plate 20 by a spring 74 shown diagrammatically in FIG. 9. One spring has been shown in the drawings, but naturally, more than one spring may be used. Spring 74 is received in a central spring pocket 76 (FIG. 10) formed in friction shoe 70 and is compressed between a lower wall 78 of bolster 66 and an upper wall 80 of friction shoe 70. Spring 74 urges surface 82 of inclined wings 84, which project outwardly from opposite sides of body portion 86 of friction shoe 70, into engagement with guiding surface 88 of bolster 66.

Referring now to FIG. 10, friction wall 72 of friction shoe 70 is shown having a contact surface that is laterally concave. It should be noted that the interface between friction wall 72 and friction surface 28 of plate 20 can be arranged in any of the manners illustrated in FIGS. 4 through 7 above. That is, friction surface 28 can be made laterally concave as shown in FIG. 4, or the contact surface of friction wall 72 can be made to conform with the configuration of wall 44, 52 or 58 in FIGS. 5, 6 and 7 respectively. It should be noted again that any combination of the above configurations can be used.

According to the present invention as applied to winged friction shoes, the upper surfaces 82 of wings 84 are each inclined with respect to guiding surface 88 so that initial contact is made between surfaces 82 and 88 along the lateral ends 90 of surfaces 82. The lateral ends 90 are those ends of surfaces 82 which are spaced farthest from the longitudinal axis 40 of the side frame 10. Surface 82 forms an angle C with surface 88. The apex of angle C is at the lateral end 90 of surface 82.

It is important that surface 82 contact surface 88 at lateral end 90. However, if angle C is permitted to be too large, rapid wear will occur on wing 84 resulting in a short service life of friction shoe 70. Angle C, therefore, must be carefully controlled. The best results will be achieved when angle C is held within the range of about 2° to about 4°.

When surfaces 82 contact surfaces 88 along lateral ends 90, friction shoes 70 will resist the tendency of bolster 66 to lozenge in much the same manner as shown in FIG. 2. As bolster 66 begins to rotate in a counter-clockwise direction as shown in FIG. 8, for example, the friction shoe at the left of FIG. 8 will exert a force D on bolster 66 along the lateral end 90 near the top of FIG. 8. At the same time, the friction shoe at the right of FIG. 8 will exert a force E on bolster 66 along the lateral end 90 near the bottom of FIG. 8. Therefore, whenever the bolster 66 begins to move out of its perpendicular relationship to side frame 10, a restraining moment of the forces D and E will be exerted on bolster 66 urging it back into a perpendicular relationship with side frame 10.

It should be noted further than the friction shoe receiving pocket need not be provided in the bolster as described herein, but may, for example, be formed in the side frame. In this latter type of construction, the friction shoe would engage a relatively movable friction surface on the bolster and would be in spring biased engagement with guiding surfaces in the side frame member.

I claim:

1. A truck squaring apparatus for a railway car truck comprising: a side frame having a column a relatively vertically movable bolster supported adjacent thereto; a friction surface on said column; a friction shoe pocket having a guiding surface on said bolster a friction shoe disposed in said pocket and having a first wall engageable with said friction surface on said column and a second wall engageable with said guiding surface; said respective engaging surfaces and walls having a transversely disposed recess intermediate spaced ends thereof and extending in the direction of relative movement so that initial contact between said engaging surfaces and walls is made adjacent said spaced ends of said walls.

2. The apparatus as defined in claim 1 further characterized in that said friction surface is concave in a direction transverse to the direction of relative movement.

3. The apparatus as defined in claim 1 further characterized in that said guiding surface is concave in a direction transverse to the direction of relative movement.

4. The apparatus as defined in claim 1 further characterized in that said first wall is concave in a direction transverse to the direction of relative movement.

5. The apparatus as defined in claim 1 further characterized in that said second wall is concave in a direction transverse to the direction of relative movement.

6. The apparatus as defined in claim 1 further characterized in that said first wall has raised surfaces adjacent both said ends to provide said recess.

7. The apparatus as defined in claim 1 further characterized in that said second wall has raised surfaces adjacent both said ends to provide said recess.

8. The apparatus as defined in claim 1 further characterized in that said first wall comprises two surfaces tapered inwardly with respect to said shoe from the ends of said first wall toward the center of said first wall forming a concave dihedral angle in said first wall with its apex near the center of said first wall.

9. The apparatus as defined in claim 1 further characterized in that said second wall comprises two surfaces tapered inwardly with respect to said shoe from said ends of said second wall toward the center of said second wall forming a concave dihedral angle in said second wall with its apex near the center of said second wall.

* * * * *